US012733714B2

(12) United States Patent
Oleson et al.

(10) Patent No.: US 12,733,714 B2
(45) **Date of Patent: *Sep. 15, 2026**

(54) FOOTWEAR HAVING A SUSPENDED ELASTIC MEMBRANE

(71) Applicant: Lululemon Athletica Canada Inc., Vancouver (CA)

(72) Inventors: Mark Arthur Oleson, Portland, OR (US); Michael Andrew Notrica, Portland, OR (US); Donald Taylor Johnston, Portland, OR (US); Michael Steszyn, Portland, OR (US); Peter Valois, Portland, OR (US); Peter Rueegger, Portland, OR (US); Joseph Mcmillan, Portland, OR (US)

(73) Assignee: Lululemon Athletica Canada Inc., Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 19/191,975

(22) Filed: Apr. 28, 2025

(65) Prior Publication Data

US 2025/0248487 A1 Aug. 7, 2025

Related U.S. Application Data

(63) Continuation of application No. 17/436,468, filed as application No. PCT/CA2020/050308 on Mar. 6, 2020, now Pat. No. 12,310,452.

(60) Provisional application No. 62/815,252, filed on Mar. 7, 2019.

(51) Int. Cl.

| | |
|---|---|
| ***A43B 23/02*** | (2006.01) |
| ***A43B 7/14*** | (2022.01) |
| ***A43B 13/38*** | (2006.01) |

(52) U.S. Cl.
CPC ..... *A43B 23/0205* (2013.01); *A43B 7/14* (2013.01); *A43B 13/38* (2013.01)

(58) Field of Classification Search
CPC ..... A43B 13/38; A43B 13/42; A43B 13/18; A43B 13/386; A43B 13/181; A43B 23/028
See application file for complete search history.

(56) References Cited

U.S. PATENT DOCUMENTS 1,976,819 A * 10/1934 Weiler ..... A43B 7/1495 36/166
2,845,723 A * 8/1958 Arnold ..... A43B 3/101 112/400
3,416,174 A * 12/1968 Novitske ..... A43B 13/32 12/142 E (Continued)

*Primary Examiner* — Patrick J. Lynch
(74) *Attorney, Agent, or Firm* — Kolitch Romano Dascenzo Gates LLP

(57) ABSTRACT

An article of footwear may include an elastic membrane suspended within an interior of an upper of the article of footwear and spaced above the sole, such that a wearer's foot contacts the membrane and is cradled by the membrane as the membrane is stretched toward an underlying midsole. In some examples, the membrane may contact the midsole for a discrete length of a contact area, e.g., selected by the manufacturer. In some examples, a void between the membrane and the sole is filled, at least in part, with a selected filler material. In some examples, the membrane comprises a material having tailored stretch characteristics.

20 Claims, 8 Drawing Sheets

(56) References Cited

U.S. PATENT DOCUMENTS

| | | | | | |
|---|---|---|---|---|---|
| 4,926,569 | A * | 5/1990 | Bunch | A43B 7/1463 | 36/170 |
| 5,060,402 | A * | 10/1991 | Rosen | A43B 3/26 | 36/97 |
| 5,595,002 | A * | 1/1997 | Slepian | A43B 1/0072 | 36/114 |
| 5,733,647 | A * | 3/1998 | Moore, III | A43B 7/1464 | 36/43 |
| 5,753,357 | A * | 5/1998 | Filipitsch | B01J 20/28078 | 36/43 |
| 8,839,530 | B2 * | 9/2014 | Smith | A43B 9/02 | 36/12 |
| 9,474,326 | B2 * | 10/2016 | Langvin | A43B 13/122 | |
| 2004/0163280 | A1 * | 8/2004 | Morris | A43B 9/00 | 36/28 |
| 2009/0119953 | A1 * | 5/2009 | Lin | A43B 7/08 | 36/3 R |
| 2012/0216430 | A1 * | 8/2012 | Stohr | A43B 7/1464 | 36/25 R |
| 2012/0260526 | A1 * | 10/2012 | Smith | A43B 9/02 | 36/83 |
| 2013/0318817 | A1 * | 12/2013 | Vattes | A43B 23/22 | 36/28 |
| 2016/0219973 | A1 * | 8/2016 | Cheney | A43B 13/38 | |
| 2017/0245591 | A1 * | 8/2017 | Ringholz | A43B 17/102 | |
| 2020/0085140 | A1 * | 3/2020 | Hurd | B29D 35/142 | |

* cited by examiner

FOOTWEAR HAVING A SUSPENDED ELASTIC MEMBRANE

CROSS-REFERENCES

The following applications and materials are incorporated herein by reference, in their entireties, for all purposes: U.S. Provisional Patent Application Ser. No. 62/815,252, filed Mar. 7, 2019; International Application Serial No. PCT/CA/2020/050308, filed under the Patent Cooperation Treaty on Mar. 6, 2020; and U.S. patent application Ser. No. 17/436,468, filed Sep. 3, 2021.

FIELD

This disclosure relates to systems and methods for footwear. More specifically, the disclosed embodiments relate to footwear having internal support systems.

INTRODUCTION

Articles of footwear, especially articles of footwear such as running shoes or other athletic shoes, often include features designed to support the foot of a wearer. These features often include shock-absorbing foams, shanks, or structures, which may reduce an impact of a foot strike on the body of a wearer. Features may also include arch supports, configured to reduce pronation. Additional features may include cushioning, which may improve the feel of the shoe. However, shoes including these features may be heavy or may provide too much support for a wearer who prefers lightweight shoes. There is a need for shoes which provide arch support and shock absorption for the wearer, while remaining lightweight and adaptable to the foot of the wearer.

SUMMARY

The present disclosure provides systems, apparatuses, and methods relating to footwear having an internal foot support system.

In some embodiments, an article of footwear according to aspects of the present disclosure may include: an upper coupled to a sole and having medial and lateral interior sidewalls, and a perimeter below the medial and lateral interior sidewalls defining where the upper and the sole meet, wherein the upper and the sole collectively define an interior region; and an elastic membrane configured to stretch toward the sole underlying the elastic membrane during wear, wherein the elastic membrane is coupled to at least a portion of the medial and lateral interior sidewalls of the upper and is suspended within the interior region, such that at least a portion of the elastic membrane is spaced above the sole and spans between the medial and lateral interior sidewalls; wherein the elastic membrane comprises two or more zones with selected stretch behavior characteristics, wherein the two or more zones comprise a first zone having a first set of stretch behavior characteristics and a second zone having a second set of stretch behaviors different than the first set of stretch behaviors.

In some embodiments, an article of footwear according to aspects of the present disclosure may include: an upper coupled to a sole and having medial and lateral interior sidewalls, and a perimeter below the medial and lateral interior sidewalls defining where the upper and the sole meet, wherein the upper and the sole collectively define an interior region; and an elastic membrane coupled to the medial and lateral interior sidewalls of the upper along an entire forefoot region of the article of footwear or coupled to the sole along the entire forefoot region of the article of footwear, and suspended within the interior region, such that at least a portion of the elastic membrane is spaced above the sole and spans between the medial and lateral interior sidewalls; wherein the elastic membrane comprises two or more zones with selected stretch behavior characteristics, wherein the two or more zones comprise a first zone having a first set of stretch behavior characteristics and a second zone having a second set of stretch behaviors different than the first set of stretch behaviors.

In some embodiments, an article of footwear according to aspects of the present disclosure may include: an upper coupled to a sole and having medial and lateral interior sidewalls, and a perimeter below the medial and lateral interior sidewalls defining where the upper and the sole meet, wherein the upper and the sole collectively define an interior region; and an elastic membrane coupled to at least a portion of the medial and lateral interior sidewalls of the upper and suspended within the interior region, such that at least a portion of the elastic membrane is spaced above the sole and spans between the medial and lateral interior sidewalls; wherein the elastic membrane comprises two or more zones with selected stretch behavior characteristics, wherein the two or more zones comprise a first zone having a first set of stretch behavior characteristics and a second zone having a second set of stretch behaviors different than the first set of stretch behaviors.

Features, functions, and advantages may be achieved independently in various embodiments of the present disclosure, or may be combined in yet other embodiments, further details of which can be seen with reference to the following description and drawings.

DETAILED DESCRIPTION

Figure 1:
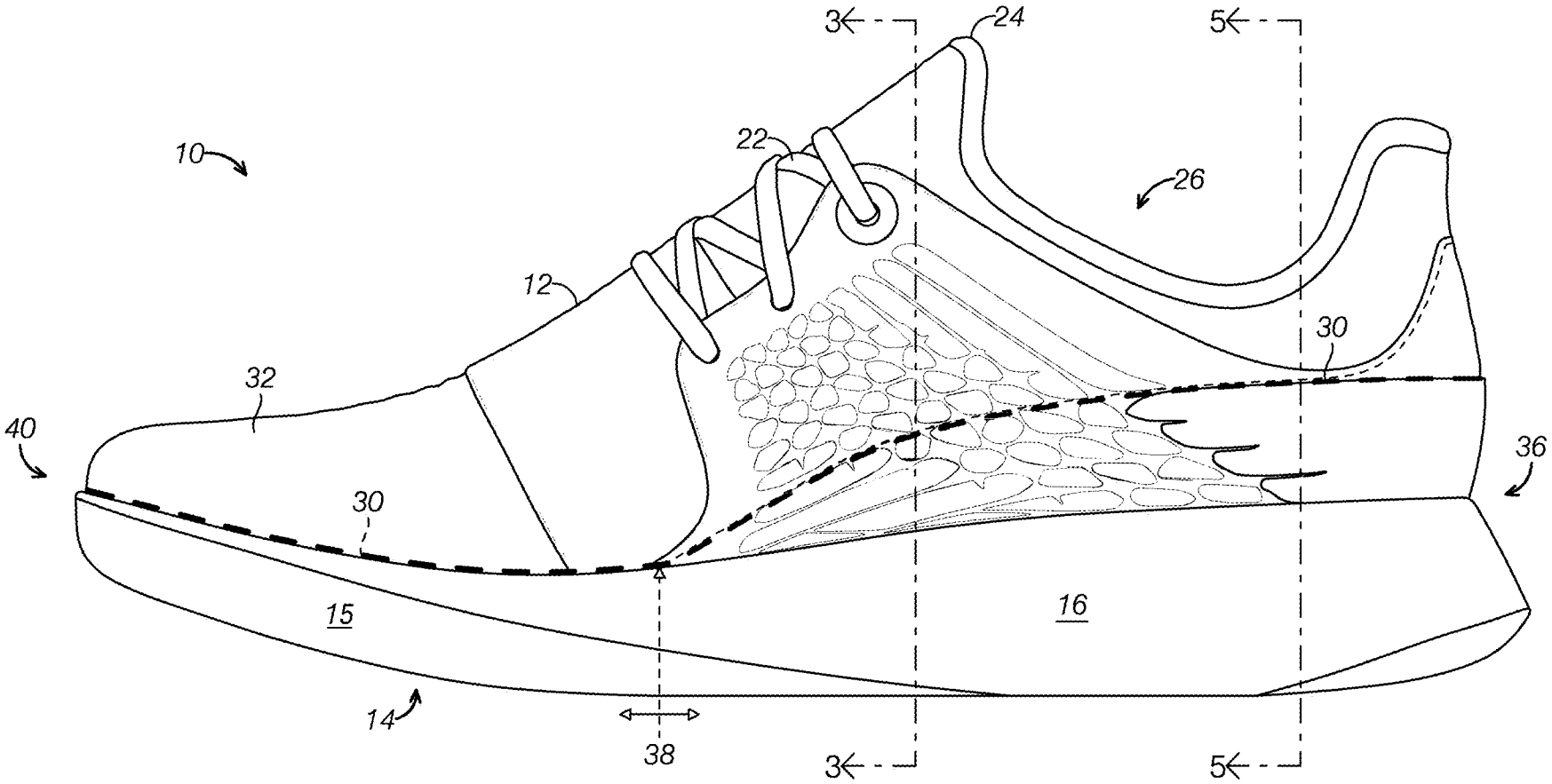
FIG. 1 is a side elevation view of an illustrative article of footwear having a suspended elastic membrane incorporated therein, in accordance with aspects of the present disclosure, depicting a profile of the elastic membrane in the interior of the shoe.

Various aspects and examples of an article of footwear having a suspended elastic membrane, as well as related methods, are described below and illustrated in the associated drawings. Unless otherwise specified, an article of footwear in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections A and B, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

The terms "medial," "lateral," "anterior," "posterior," and the like are intended to refer to anatomical directions corresponding to a human foot wearing an article of footwear. For example, "medial" refers to a relative position disposed toward the center of the human body, while "lateral" refers to a relative position disposed away from the center of the human body. "Anterior" refers to a relative position closer to the toe of a wearer and "posterior" refers to a relative position closer to the heel of a wearer. In the absence of a wearer, the same directional terms may be used as if the article of footwear is being worn in its expected configuration.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

"Providing," in the context of a method, may include receiving, obtaining, purchasing, manufacturing, generating, processing, preprocessing, and/or the like, such that the object or material provided is in a state and configuration for other steps to be carried out.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

An article of footwear as described herein includes an elastic membrane suspended within an interior of an upper of the article of footwear and spaced above the sole. A wearer's foot contacts the membrane and is cradled by the membrane as the membrane is stretched toward an underlying midsole. In some examples, the membrane has a length shorter than the underlying midsole, and/or is in contact with the midsole for a selected length of a contact area. For example, a front portion of the membrane may be affixed to or continuous with the midsole. In some examples, a void between the membrane and the sole is filled, at least in part, with a selected filler material. In some examples, the membrane comprises a material having tailored stretch characteristics.

The membrane may be suspended using various methods described herein. In some examples, the membrane is attached to interior sidewalls of the upper using stitching, bonding, adhesive, clamping, fasteners, and/or the like. In some examples, the membrane is at least partially suspended from shoelaces (e.g., at the eyelets). The attachment between membrane and sidewalls (and/or membrane and laces) provides a void space beneath the membrane, such that a foot of the wearer is suspended by the membrane (e.g., as by a hammock).

In some examples, the membrane extends an entire length of the article of footwear. In some examples, (e.g., when the membrane is supported by laces), the membrane extends only under the arch of a wearer. In some examples, the membrane extends under the arch and a portion of the heel of a wearer's foot.

Examples, Components, and Alternatives

The following sections describe selected aspects of illustrative articles of footwear including suspended elastic membranes, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Article of Footwear

As shown in FIGS. 1-9, this section describes an illustrative article of footwear including a suspended elastic membrane. The article of footwear of the present disclosure is illustrated as a shoe 10, but may include any article of footwear capable of attaching and/or suspending a suitable membrane. For example, the article of footwear may be a slip-on shoe, lace-less shoe, sandal, and/or the like.

Figure 2:
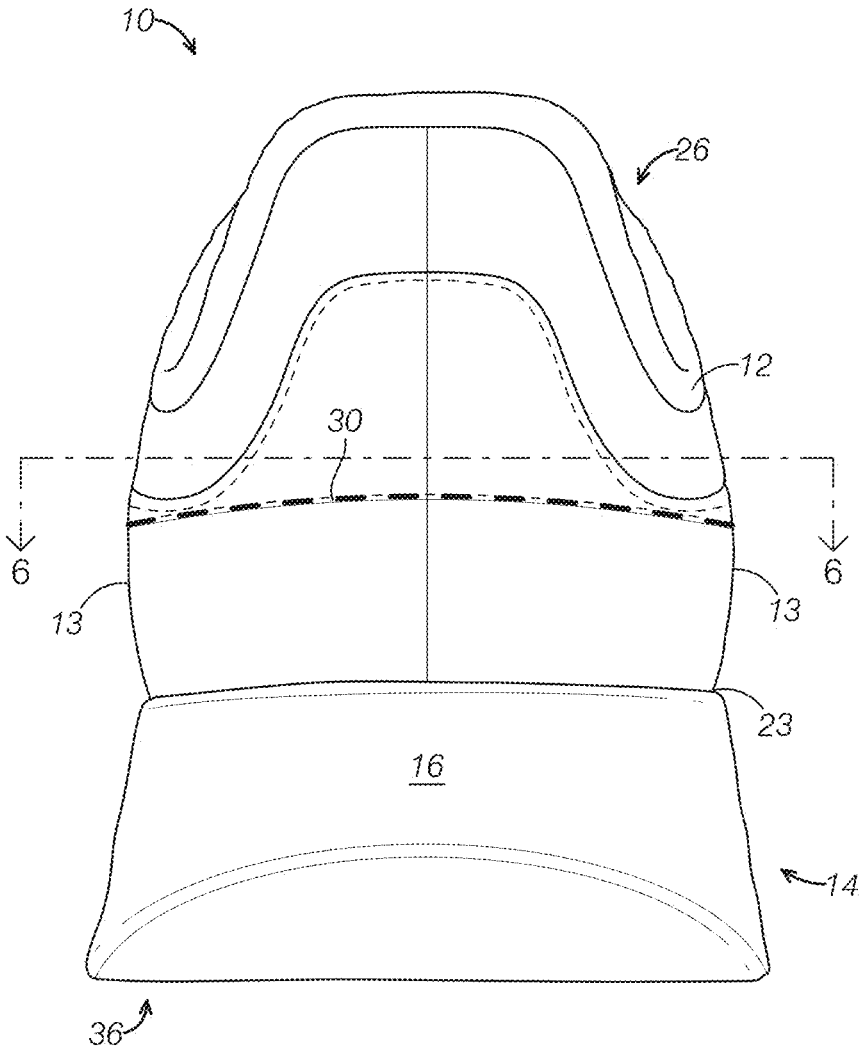
FIG. 2 is a rear elevation view of the article of footwear of FIG. 1.
Figure 3:
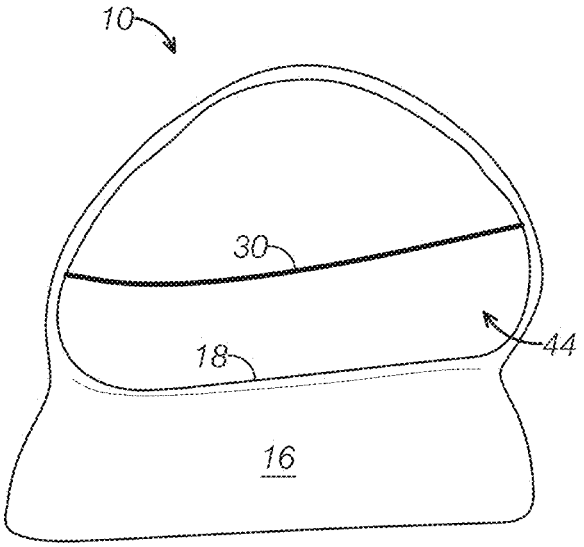
FIG. 3 is a sectional view of the article of footwear of FIG. 1, taken at cut line 3-3, with the suspended membrane in a first configuration.

As shown in FIGS. 1 and 2, shoe 10 includes an upper 12 coupled to a sole 14, where sole 14 includes an outsole 15, a midsole 16, and, in some examples, an insole 18 (see FIG. 3). The upper 12 has medial and lateral sidewalls 13 and a perimeter 23 below the sidewalls defining where the upper and sole meet. An interior region 20 (see FIG. 5) of the shoe is defined between upper 12 and midsole 16, and includes insole 18 and/or a floating sockliner. Shoe 10 has a laced upper, and includes a shoelace 22, a tongue 24, and a foot opening 26.

An elastic membrane 30 (AKA a web, an expanse, or a sheet) is disposed within interior region 20, such that membrane 30 is spaced above at least a part of midsole 16 (see FIG. 3). Membrane 30 continuously spans from sidewall 13 to sidewall 13 of interior region 20, and is generally parallel to the midsole, at least in a heel region of the shoe. As depicted in FIG. 1, a side profile of membrane 30 curves generally downward, toward the midsole, as the membrane approaches a toe box 32 of the shoe. In some examples, the side profile of membrane 30 is configured to generally follow a side profile of the sole of a human foot. In some examples, the side profile is configured to correct a profile of the foot by following a profile which is offset or transverse with respect to the profile of the foot.

Membrane 30 is suspended above the midsole for a selected length of the shoe, e.g., from a heel end 36 to a midsole contact area 38. Accordingly, a height of membrane 30 above the midsole 16 decreases as membrane 30 approaches a toe end 40 of the shoe. Contact area 38 may be selected by the manufacturer, and may be disposed at any point along a length of the shoe, to achieve a desired level of support. Forward of midsole contact area 38, membrane 30 may terminate, or may be affixed to the midsole (e.g., layered onto the midsole). In some examples, a partial insole and/or sockliner overlays membrane 30 in areas forward of midsole contact area 38. In some examples, membrane 30 remains spaced above the midsole for substantially the entire length of the interior region.

Membrane 30 may be incorporated into upper 12 using any suitable method or mechanism configured to keep the perimeter (AKA perimeter region) of the membrane fixed to the shoe at a selected height and side profile. For example, membrane 30 may be affixed to the sidewalls of upper 12 (e.g., the inner surface of the sidewalls) and/or to the midsole 16 (e.g., the inner surface of the midsole), by way of stitching, bonding, adhesive, clamping, fasteners, and/or the like. In some examples, membrane 30 may be affixed to the shoe by having the perimeter region sandwiched between two components of the shoe (e.g., between the midsole and the outsole or between the midsole and the upper). In some examples, membrane 30 may be attached to the shoe in a partially stretched condition, a tight condition, and/or a taut condition. In some examples, membrane 30 may have a top profile which does not exactly conform to a top profile of the midsole. In these examples, portions of the membrane may be attached to the shoe in a partially stretched condition and other portions of the membrane may be attached to the shoe in a slack or drooping condition.

Figure 5:
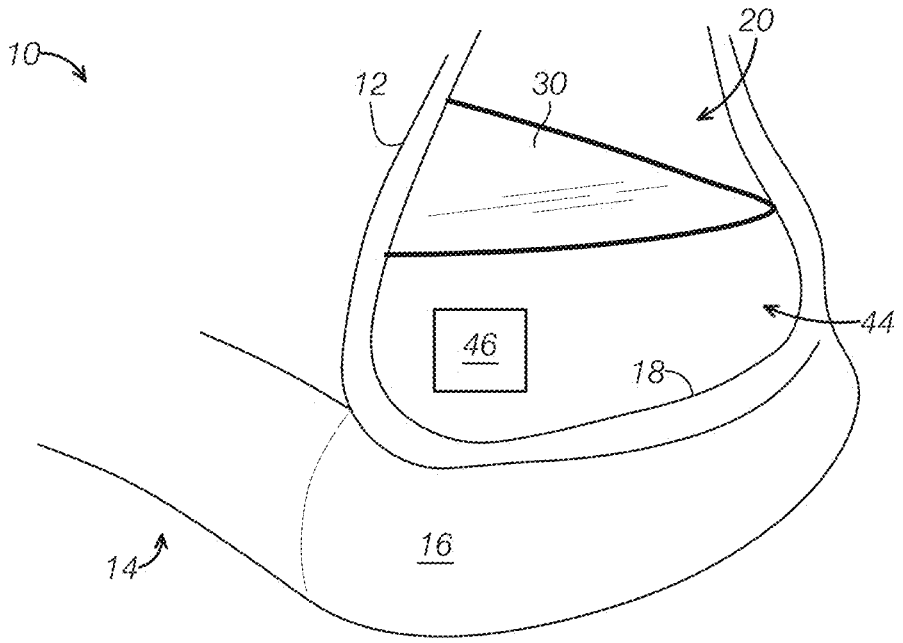
FIG. 5 is an isometric sectional view of a portion of the article of footwear of FIG. 1, taken at cut line 5-5.

As depicted in FIG. 5, the spacing of membrane 30 above midsole 16 creates a void 44 between the sole and the membrane. In some examples, this void is empty. In some examples, a filler material 46 is provided in void 44, at least partially filling the void and providing a different foot feel to the user. Filler material 46 is represented schematically in FIG. 5 and may include any suitable substance or material configured to impart a desired feeling to the underside of the user's foot while still allowing membrane 30 to stretch and return (at least to some degree). For example, filler material 46 may include a granular material, such as solid or hollow beads (e.g., spherical beads, cylindrical beads, etc.). This may be configured to give the user a sense of walking on sand, or to massage the user's foot. In some examples, filler material 46 may comprise a foam or any other suitable compressible or dispersible material. In some examples, membrane 30 is configured to be removable, and filler material 46 is configured to be replaceable by a user.

Figure 4:
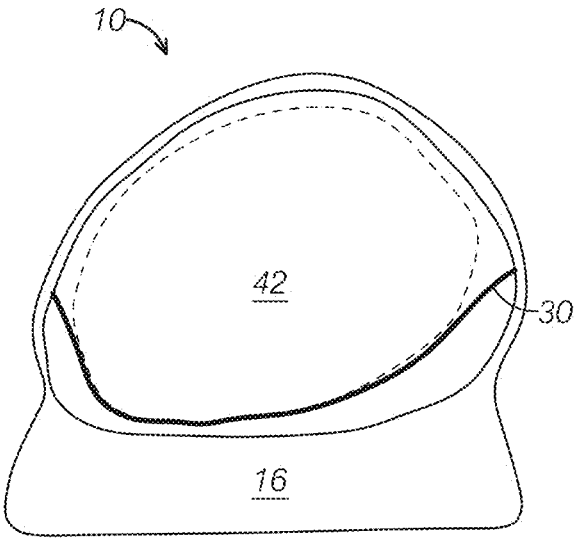
FIG. 4 is the sectional view of the article of footwear of FIG. 1, taken at cut line 3-3 and with the suspended membrane in a second configuration.

In general, at least some parts of a user's foot are typically out of contact with the midsole when a shoe is being worn. As depicted in the drawings, membrane 30 in this example extends from sidewall to sidewall (see FIG. 5), such that the membrane is supported on all sides by the structure of shoe 10. In some examples, one or more peripheral portions of the membrane are attached (e.g., directly) to the midsole. In any event, the membrane's support by the shoe provides the elastic membrane with a trampoline-like arrangement, and facilitates the support and partial embracing of a user's foot 42, as shown in FIG. 4. Accordingly, portions of foot 42 that are not in contact with the midsole 16 are given some degree of support by the membrane. In addition to providing a unique feeling for the wearer, this may provide additional benefits, such as enhanced stability and reduction in friction or rubbing, among other benefits.

Figure 6:
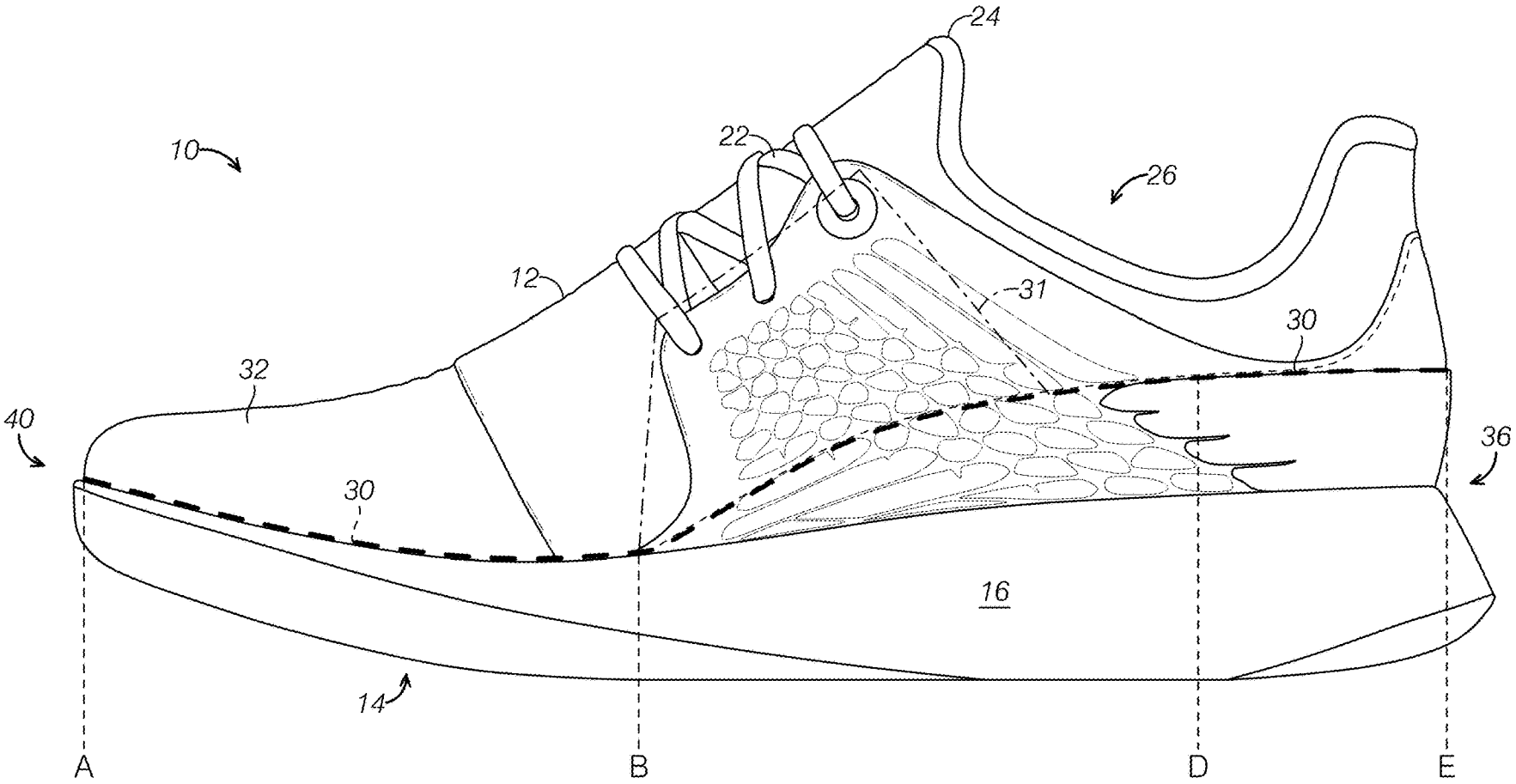
FIG. 6 is a side elevation view of an illustrative article of footwear having an elastic membrane suspended by laces of the article of footwear.

In some examples, membrane 30 extends only a partial length of shoe 10. An example of this is illustrated in FIG. 6, where selected membrane termination areas are shown. In some examples, membrane 30 extends from area A near the toe to area E at the heel. In this case, membrane 30 is affixed to the midsole along an entire forefoot region and is further coupled to a heel of the shoe. In some examples, membrane 30 may extend from area B at the midfoot to area E at the heel. In this case, membrane is affixed to the midsole for only a short distance along the forefoot region, or is not affixed to the midsole at any point. In some examples, membrane 30 may extend from area B at the midfoot to area D part way to the heel, leaving a gap near the heel of the shoe. In some examples, membrane 30 may extend from area B at the midfoot to area D or area E. For example, the membrane may be disposed only under the arch of the user.

In some examples, lateral and/or medial support structures are utilized to secure and/or support the membrane, either in addition to or instead of the connection to sides of the upper. In some examples, membrane 30 includes wings 31 extending from the perimeter of the membrane at a lateral and a medial edge and extending upward toward a top of the shoe. Wings 31 may be coupled to the upper in any suitable manner. In some examples, wings 31 are suspended from shoelace 22. For example, the wings may include apertures at distal ends that correspond to the shoelace eyelets in the upper. The shoelace is threaded Through the shoe eyelets and the wing apertures, such that the wings are suspended from the top portion of the upper. In some examples, wings 31 may be coupled to an insole or sockliner of the shoe. In some examples, the wings are generally rectangular extensions configured to wrap around the arch of the user. In some examples, the wings are trapezoidal, triangular, and/or otherwise wider at a proximal end than at a distal end (i.e., near the laces). In some examples, membrane 30 may be removable. For example, membrane 30 may be supported within the shoe by only wings 31, such that removal from the laces allows simple removal of the membrane from within the upper. In some examples, membrane may include only a single wing 31, which is configured to wrap around the user's insole (e.g., on a medial side of the foot) upward (i.e., toward lace 22). Wings 31 may provide additional arch support for the wearer and/or a support structure for membrane 30.

Membrane 30 may include any suitable synthetic and/or natural material(s) configured to provide an elastic support for a user's foot 42 (see FIG. 4). For example, membrane 30 may comprise one or more layers of elastane, AKA spandex (e.g., Lycra® brand) or any material with a constant or variable elastic modulus. Membrane may comprise material selected to conform to foot 42, such that the membrane wraps, cradles, and/or otherwise fully contacts a bottom surface of the foot. In some examples, membrane 30 may be textured, perforated, non-continuous and/or have any suitable surface modification configured to improve feel for the wearer. In some examples, at least part of the membrane may be made of a shape-memory material.

Figure 7:
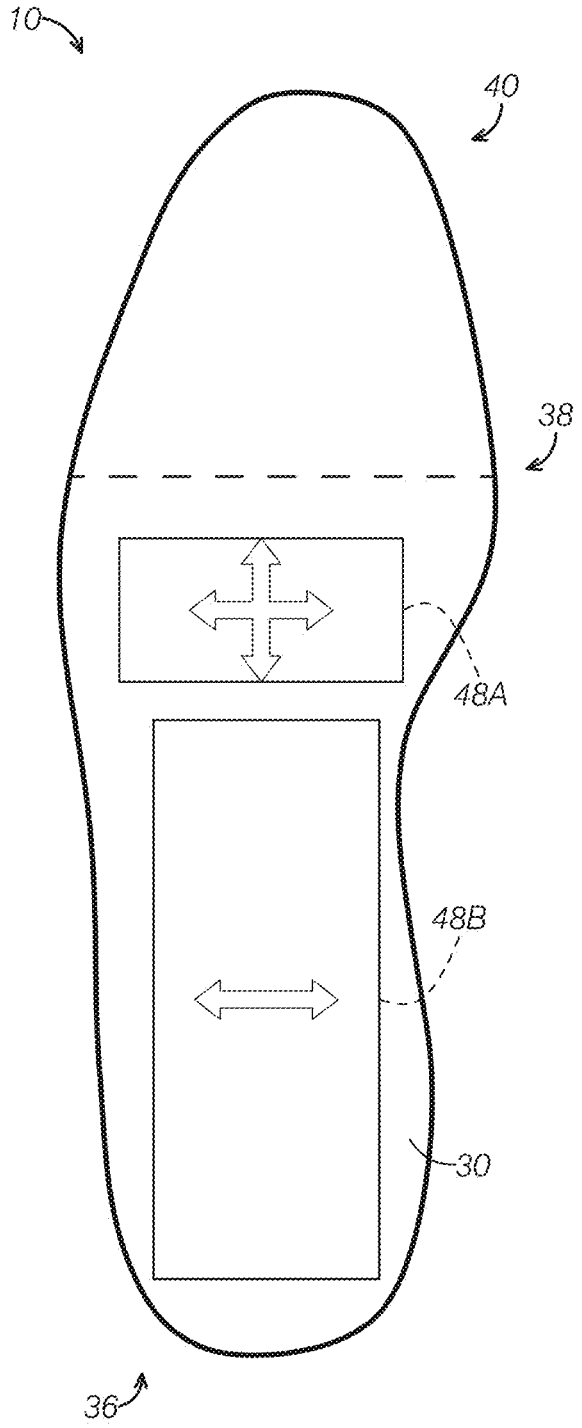
FIG. 7 is a top sectional view of the article of footwear of FIG. 2, taken at cut line 6-6.

In some examples, membrane 30 is modular and/or zonal, as shown schematically in FIG. 7, such that some zones of the membrane are configured to have functionally different modular stretchability characteristics. For example, a first zone 48A may be stretchable in four directions while a second zone 48B is stretchable on only two directions (i.e., resistant to stretching in the other two directions). Any suitable number, orientation, and/or arrangement of such zones may be utilized, to provide a desired effect on user comfort and/or functionality.

In some examples, membrane 30 comprises a continuous piece of layered material configured to have one, two, or more stretch zones. The layered material may include first and second outer layers, each configured to be highly stretchable (e.g., in all directions). In some examples, the first and second outer layers comprise an elastic material (e.g., elastane), and are identical or nearly identical to each other. One or more intermediate materials having selected stretch characteristics may be disposed between the first and second outer layers, providing the overall layered material with a distinct stretch zones having selected characteristics.

Figure 8:
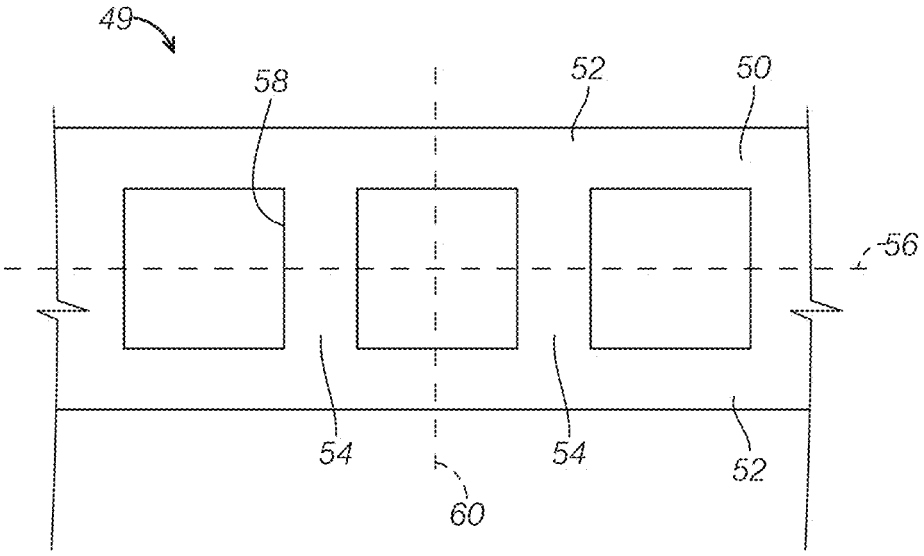
FIG. 8 is a schematic view of a first illustrative material including stretch zones, suitable for inclusion in the elastic membrane of FIGS. 1-7.

FIG. 8 illustrates a schematic view of an exemplary intermediate material 49 which is stretchable in only two directions. This intermediate material may be suitable, for example, for inclusion in stretch zone 48B. Material 49 comprises a ladder-shaped grid 50 layered with an elastic material or sandwiched between layers of elastic material. Grid 50 includes a pair of opposing rails 52 and a plurality of rungs 54. Rungs 54 are spaced from each other and each extend between rails 52. Rails 52 define a longitudinal axis 56. Rails 52 and rungs 54 comprise a material capable of stretching during ordinary operation (e.g., a foam), but less stretchable than the outer layer(s). A plurality of ladder openings 58 are defined between rails 52 and pairs of rungs 54. In the depicted material, openings 58 are square-shaped, but in general the openings may have any suitable shape. The absence of material at openings 58 allows ladder-shaped grid 50 to stretch along longitudinal axis 56 to a much greater extent than along a transverse axis 60 orthogonal to the longitudinal axis. Material 49 may be covered by one or more layers of elastic material, as described above. In some examples, material 49 is sandwiched between two layers of elastic material (e.g., spandex), so that material 49 appears uniform, may extend continuously with other layered zones having differing characteristics, and is not exposed to or in contact with the wearer's foot.

Figure 9:
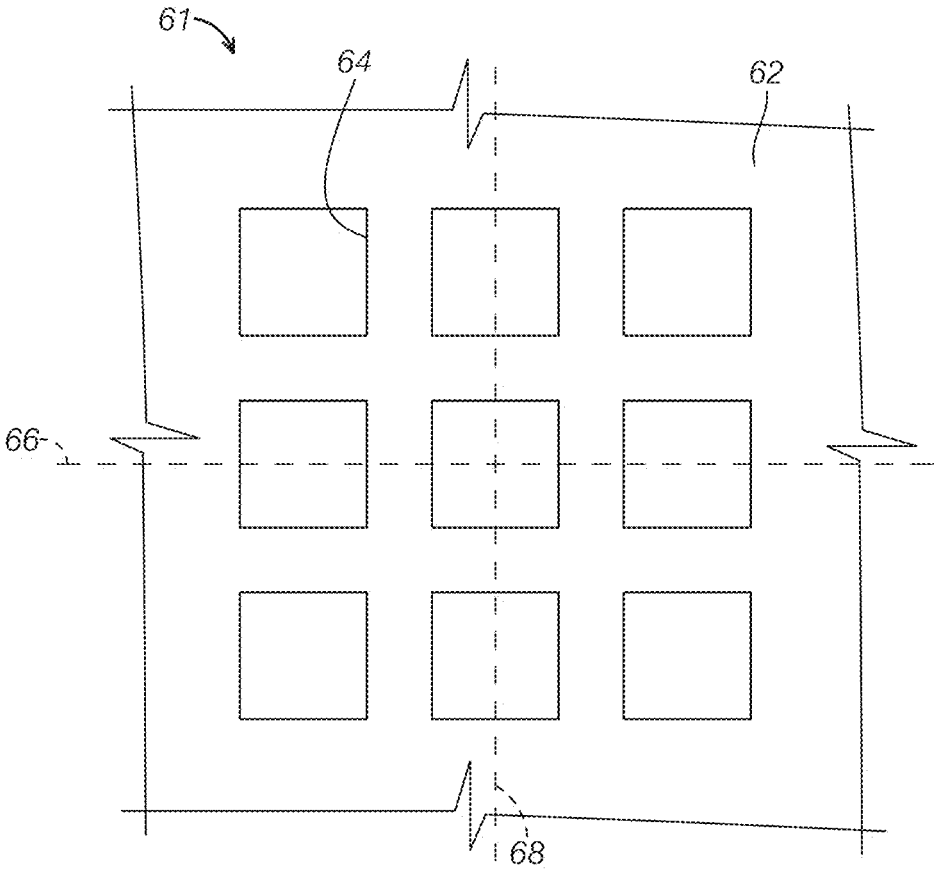
FIG. 9 is a schematic view of a second illustrative material including stretch zones, suitable for inclusion in the elastic membrane of FIGS. 1-7.

FIG. 9 illustrates a schematic view of an exemplary intermediate material 61 which is stretchable in four selected directions. This intermediate material may be suitable, for example, for inclusion in stretch zone 48A. Material 61 comprises at least one stretchable sheet 62 (e.g., of foam) having an array of openings 64 and layered with an elastic material or sandwiched between layers of elastic material. In the depicted example, openings 64 are square-shaped, but in general the openings may have any suitable shape. The array of openings 64 define a first stretching axis 66 and an orthogonal second stretching axis 68. Rows and/or columns of the array of openings 64 are aligned with first and second stretching axes 66 and 68, enabling sheet 62 to stretch along directions parallel to the first and second stretching axes. Similar to material 49, material 61 may be covered by one or more layers of elastic material, as described above. In some examples, material 61 is sandwiched between two layers of elastic material (e.g., spandex), so that material 61 appears uniform, may extend continuously with other layered zones having differing characteristics, and is not exposed to or in contact with the wearer's foot.

Figure 10:
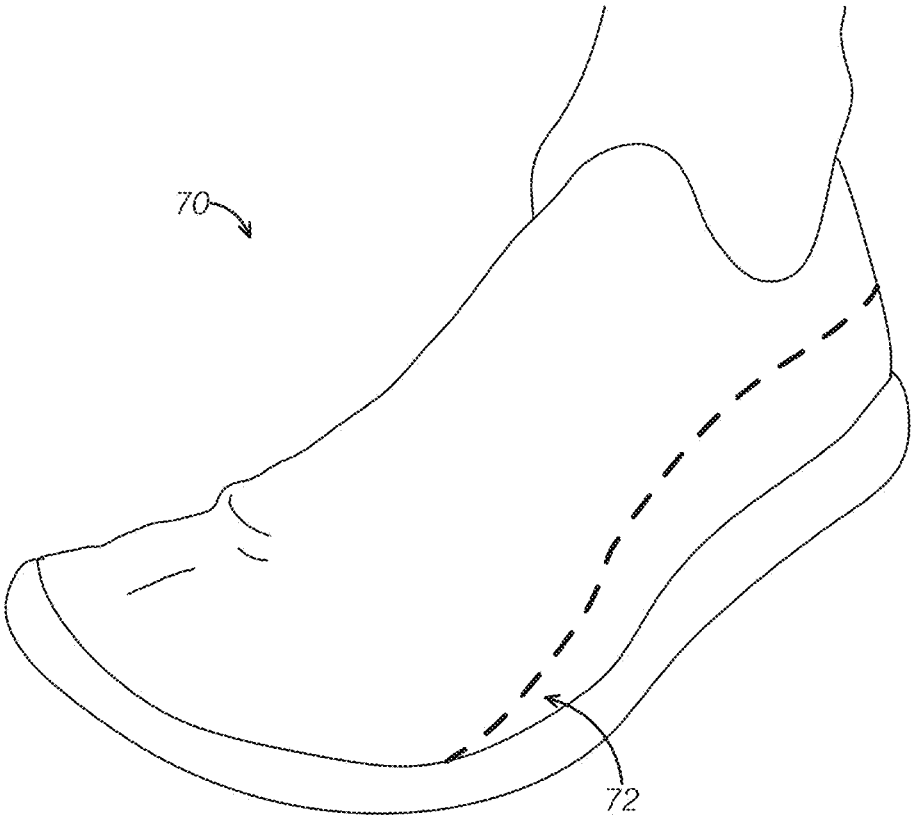
FIG. 10 is an oblique view of another illustrative article of footwear having a suspended elastic membrane similar to that shown in FIG. 1.

Footwear described herein may include various types of footwear, such as other types of shoes, boots, slippers, and the like. For example, a second article of footwear in the form of a slip-on shoe 70 is depicted in FIG. 10. Slip-on shoe 70 has an internal elastic membrane 72, as indicated in the drawing, substantially similar to that of shoe 10.

The disclosure set forth above may encompass multiple distinct examples with independent utility. Although each of these examples has been disclosed in its preferred form(s), the specific embodiments thereof as disclosed and illustrated herein are not to be considered in a limiting sense, because numerous variations are possible. The subject matter of the example(s) includes all novel and nonobvious combinations and subcombinations of the various elements, features, functions, and/or properties disclosed herein.

Certain combinations and subcombinations regarded as novel and nonobvious are particularly pointed out throughout this disclosure. Other combinations and subcombinations of features, functions, elements, and/or properties may be claimed, with or without variation in scope, in applications claiming priority from this or a related application.

Explicit reference is hereby made to all examples, embodiments, inventions, labels, terms, descriptions, and illustrative measurements shown in the drawings and/or in any included appendices, whether or not described further herein. To the extent that section headings are used within this disclosure, such headings are for organizational purposes only.

B. Illustrative Combinations and Additional Examples

This section describes additional aspects and features of articles of footwear including suspended elastic membranes, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. An article of footwear comprising:

a sole;

an upper coupled to the sole; and an elastic membrane coupled to the upper such that the elastic membrane is suspended above the sole within the upper.

A1. The article of footwear of A0, wherein the elastic membrane comprises one or more layers of elastane material.

A2. The article of footwear of A0 or A1, wherein the elastic membrane comprises one or more zones, each zone biased such that the elastic membrane in the zone is configured to be more stretchable in one or more selected directions than in other directions.

A3. The article of footwear of A2, wherein at least one of the zones is biased to be stretchable in two directions and resistant to stretching in other directions.

A4. The article of footwear of A2 or A3, wherein the elastic membrane comprises a patterned foam layer sandwiched between two layers of elastane material.

A5. The article of footwear of any one of paragraphs A0 through A4, wherein a height of the elastic membrane above the sole tapers downward from rear to front as the elastic membrane approaches a toe box of the article of footwear.

A6. The article of footwear of A5, wherein the elastic membrane contacts the sole at a point spaced from a toe end.

A7. The article of footwear of any one of paragraphs A0 through A6, wherein a void is defined between the elastic membrane and the sole, and the void is at least partially filled by a filler material.

A8. The article of footwear of A7, wherein the filler material is granular and loosely disposed (e.g., beads).

A9. The article of footwear of any one of paragraphs A0 through A8, wherein a perimeter region of the elastic membrane is affixed to the upper.

A10. The article of footwear of A9, wherein the perimeter region is stitched to the upper.

A11. The article of footwear of any one of paragraphs A0 through A10, wherein the elastic membrane comprises a first wing extending from a lateral side of the elastic membrane and a second wing extending from a medial side of the elastic membrane, wherein the first and second wings of the elastic membrane are coupled to the upper by laces.

A12. The article of footwear of any one of paragraphs A0 through A11, wherein the elastic membrane has a discrete length less than a length of an interior region defined between the upper and the sole.

A13. The article of footwear of any one of paragraphs A0 through A12, wherein a perimeter region of the elastic membrane is affixed to the midsole.

A14. The article of footwear of any one of paragraphs A0 through A13, wherein the membrane is attached to the upper in a partially stretched condition.

A15. The article of footwear of any of paragraphs A0 through A14, wherein a side profile of the elastic membrane generally follows a side profile of a human foot.

B0. An article of footwear comprising:

an upper coupled to a sole and having a pair of sidewalls, wherein the upper and the sole collectively define an interior region; and an elastic membrane coupled to the upper and suspended within the interior region, such that the membrane is spaced above the sole and spans between the sidewalls.

B1. The article of footwear of B0, wherein a height of the elastic membrane above the sole tapers downward from rear to front as the membrane approaches a toe box of the article of footwear.

B2. The article of footwear of B0 or B1, wherein a void is defined between the elastic membrane and the sole, and the void is at least partially filled by a filler material.

B3. The article of footwear of any one of paragraphs B0 through B2, wherein a perimeter region of the elastic membrane is stitched to the upper.

B4. The article of footwear of any one of paragraphs B0 through B3, wherein the elastic membrane comprises a first wing extending from a lateral side of the elastic membrane and a second wing extending from a medial side of the elastic membrane, wherein the first and second wings of the elastic membrane are coupled to the upper by laces.

C0. An article of footwear comprising:

an upper coupled to a sole, such that an interior region is defined between the upper and the sole; and an elastic membrane suspended within the interior region, spaced above the sole and spanning between sidewalls of the upper.

C1. The article of footwear of C0, wherein the elastic membrane comprises at least one layer of elastane material, and a perimeter region of the elastic membrane is affixed to the upper.

Advantages, Features, and Benefits

The different embodiments and examples of the article of footwear having a suspended elastic membrane described herein provide several advantages over known solutions for providing support within shoes. For example, illustrative embodiments and examples described herein provide increased support for a wearer of the article of footwear (e.g., shoe), while minimally increasing a mass of the article of footwear.

Additionally, and among other benefits, illustrative embodiments and examples described herein may conform to a foot of the wearer, increasing comfort and reducing friction or rubbing.

Additionally, and among other benefits, illustrative embodiments and examples described herein provide support for an arch region of the user's foot, without modifying the outsole or midsole.

Additionally, and among other benefits, illustrative embodiments and examples described herein provide a foot-contacting support surface having one or more zones with selected stretch behavior characteristics.

Additionally, and among other benefits, illustrative embodiments and examples described herein provide a unique feel for a user's foot, e.g., elastically embracing lower surfaces of the foot at all times.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. An article of footwear comprising:

an upper coupled to a sole and having medial and lateral interior sidewalls, and a perimeter below the medial and lateral interior sidewalls defining where the upper and the sole meet, wherein the upper and the sole collectively define an interior region; and an elastic membrane configured to stretch toward the sole underlying the elastic membrane during wear, wherein the elastic membrane is coupled to at least a portion of the medial and lateral interior sidewalls of the upper and is suspended within the interior region, such that at least a portion of the elastic membrane is spaced above the sole and spans between the medial and lateral interior sidewalls;

wherein the elastic membrane comprises two or more zones with selected stretch behavior characteristics, wherein the two or more zones comprise a first zone having a first set of stretch behavior characteristics and a second zone having a second set of stretch behaviors different than the first set of stretch behaviors; and wherein the second zone is configured to be stretchable in two directions and resistant to stretching in other directions, or the first zone is configured to be stretchable in four directions and the second zone is configured to be stretchable in fewer than four directions.

2. The article of footwear of claim 1, wherein the first zone is configured to be stretchable in four directions and the second zone is configured to be stretchable in fewer than four directions.

3. The article of footwear of claim 1, wherein the second zone is configured to be stretchable in two directions and resistant to stretching in other directions.

4. The article of footwear of claim 1, wherein the elastic membrane comprises one or more layers of a material, and each of the one or more layers of material has a constant elastic modulus or a variable elastic modulus.

5. The article of footwear of claim 1, wherein a height of the elastic membrane above the sole tapers downward from rear to front as the elastic membrane approaches a toe box of the article of footwear.

6. The article of footwear of claim 1, wherein the elastic membrane is generally parallel to a midsole at least in a heel region of the article of footwear.

7. The article of footwear of claim 1, wherein the elastic membrane is configured to extend under an arch and a portion of a heel of a wearer's foot during wear.

8. The article of footwear of claim 1, wherein the elastic membrane is affixed to the medial and lateral interior sidewalls along an entire forefoot region of the article of footwear or is affixed to the sole along the entire forefoot region of the article of footwear.

9. The article of footwear of claim 1, wherein the elastic membrane is attached to the article of footwear in a stretched condition, a taut condition, a slack condition, or a combination thereof.

10. The article of footwear of claim 1, wherein all sides of a perimeter of the elastic membrane are supported in the article of footwear.

11. An article of footwear comprising:

an upper coupled to a sole and having medial and lateral interior sidewalls, and a perimeter below the medial and lateral interior sidewalls defining where the upper and the sole meet, wherein the upper and the sole collectively define an interior region; and an elastic membrane coupled to the medial and lateral interior sidewalls of the upper along an entire forefoot region of the article of footwear or coupled to the sole along the entire forefoot region of the article of footwear, and suspended within the interior region, such that at least a portion of the elastic membrane is spaced above the sole and spans between the medial and lateral interior sidewalls;

wherein the elastic membrane comprises two or more zones with selected stretch behavior characteristics, wherein the two or more zones comprise a first zone having a first set of stretch behavior characteristics and a second zone having a second set of stretch behaviors different than the first set of stretch behaviors; and wherein the second zone is configured to be stretchable in two directions and resistant to stretching in other directions, or the first zone is configured to be stretchable in four directions and the second zone is configured to be stretchable in fewer than four directions.

12. The article of footwear of claim 11, wherein the first zone is configured to be stretchable in four directions and the second zone is configured to be stretchable in fewer than four directions.

13. The article of footwear of claim 11, wherein the elastic membrane comprises one or more layers of a material, and each of the one or more layers of material has a constant elastic modulus or a variable elastic modulus.

14. The article of footwear of claim 11, wherein a height of the elastic membrane above the sole tapers downward from rear to front as the elastic membrane approaches a toe box of the article of footwear.

15. The article of footwear of claim 11, wherein the elastic membrane is configured to extend under a wearer's foot during wear.

16. The article of footwear of claim 11, wherein the elastic membrane is attached to the article of footwear in a stretched condition, a taut condition, a slack condition, or a combination thereof.

17. The article of footwear of claim 11, wherein all sides of a perimeter of the elastic membrane are supported in the article of footwear.

18. An article of footwear comprising:

an upper coupled to a sole and having medial and lateral interior sidewalls, and a perimeter below the medial and lateral interior sidewalls defining where the upper and the sole meet, wherein the upper and the sole collectively define an interior region; and an elastic membrane coupled to at least a portion of the medial and lateral interior sidewalls of the upper and suspended within the interior region, such that at least a portion of the elastic membrane is spaced above the sole and spans between the medial and lateral interior sidewalls;

wherein the elastic membrane comprises two or more zones with selected stretch behavior characteristics, wherein the two or more zones comprise a first zone having a first set of stretch behavior characteristics and a second zone having a second set of stretch behaviors different than the first set of stretch behaviors; and wherein the second zone is configured to be stretchable in two directions and resistant to stretching in other directions, or the first zone is configured to be stretchable in four directions and the second zone is configured to be stretchable in fewer than four directions.

19. The article of footwear of claim 18, wherein the first zone is configured to be stretchable in four directions and the second zone is configured to be stretchable in fewer than four directions.

20. The article of footwear of claim 18, wherein the elastic membrane comprises one or more layers of a material, and each of the one or more layers of material has a constant elastic modulus or a variable elastic modulus.

* * * * *